US005890432A

United States Patent [19]

Rogaliner et al.

[11] Patent Number: 5,890,432

[45] Date of Patent: Apr. 6, 1999

[54] METHOD AND APPARATUS FOR PRINTING BINGO BOOKLETS

[75] Inventors: John L. Rogaliner, South Euclid; Thomas J. Kacmarcik, North Ridgeville, both of Ohio

[73] Assignee: Arrow International, Inc., Cleveland, Ohio

[21] Appl. No.: 921,937

[22] Filed: Aug. 27, 1997

Related U.S. Application Data

[60] Provisional application No. 60/024,450 Aug. 27, 1996.

[51] Int. Cl. [6] ..... B41F 13/54; A63F 3/06

[52] U.S. Cl. ..... 101/483; 101/490; 273/269; 283/70; 283/74

[58] Field of Search ..... 101/483, 490; 273/269; 364/471.01; 283/70, 74

[56] References Cited

U.S. PATENT DOCUMENTS

| | | | |
|---|---|---|---|
| Re. 34,368 | 9/1993 | Frain . | |
| 3,427,655 | 2/1969 | Woodside . | |
| 3,822,876 | 7/1974 | Frain . | |
| 4,628,816 | 12/1986 | Six . | |
| 4,830,380 | 5/1989 | Six | 101/490 |
| 4,882,688 | 11/1989 | Kondziolka et al. . | |
| 4,885,700 | 12/1989 | Kondziolka et al. . | |
| 5,007,649 | 4/1991 | Richardson | 273/269 |
| 5,489,091 | 2/1996 | Greer et al. . | |
| 5,588,913 | 12/1996 | Hecht | 273/269 |
| 5,607,145 | 3/1997 | Lovell . | |
| 5,624,119 | 4/1997 | Leake | 273/269 |
| 5,657,991 | 8/1997 | Camarato | 273/269 |
| 5,687,971 | 11/1997 | Khaladuar | 273/269 |

*Primary Examiner*—Eugene Eickholt
*Attorney, Agent, or Firm*—Fay, Sharpe, Beall, Fagan, Minnich & McKee

[57] ABSTRACT

A method of manufacturing bingo paper includes the steps of storing a plurality of preformulated bingo faces in the memory of a computer. The computer is connected to a variable data print unit. The computer is programmed to print a first series of bingo faces. The computer is also programmed to print a second series of bingo faces wherein the first series of bingo faces is different from the second series of bingo faces. The first and second series of bingo faces can be of different sizes or can have different bingo faces in them. Alternatively, the second series of bingo faces can be identical to the first series but printed in a different order. An indicium is also printed on each bingo face of the first and second series of bingo faces. After the indicium is applied, one or more series of the bingo faces will constitute a set of bingo faces. An apparatus for printing the bingo booklets includes a computer having stored in memory a plurality of bingo faces and a variable data print unit coupled to the computer. A web is fed through the variable data print unit at which point the bingo faces are printed on the web. An indicium print unit, also coupled to the computer and located adjacent the variable data print unit, prints indicia on the web adjacent each bingo face.

28 Claims, 9 Drawing Sheets

METHOD AND APPARATUS FOR PRINTING BINGO BOOKLETS

BACKGROUND OF THE INVENTION

This application bases its priority on Provisional Application Ser. No. 60/024,450 which was filed on Aug. 27, 1996.

This invention pertains to the printing of booklets of bingo sheets. However, it should be appreciated by those of average skill in the art that the method and apparatus disclosed herein could also be employed for printing a variety of other types of printed matter including checks, business forms or advertising brochures.

Bingo is a game of chance that is becoming increasingly popular throughout the world. The most popular form of bingo played in the United States consists of a 5×5 matrix of numbers with each column of numbers listed under a letter of the word "BINGO" printed at the top of the page. There are 75 numbers that may be used in the game. Under the letter "B", five unique numbers from 1 through 15 may be listed. Under the letter "I", five unique numbers from 16 through 30 may be listed. Under the letter "N", four unique numbers from 31 through 45 may be listed. The center space of the matrix which falls under the "N" column is usually designated as a free space in the play of the game. Under the letter "G", five unique numbers from 46 through 60 may be listed. Under the letter "O", five unique numbers from 61 through 75 may be listed. The game is played by filling a prescribed pattern on the bingo face by marking the randomly generated numbers called from the 75 number series. The first person to fill the pattern and to call "BINGO" wins the game.

Previously the game of bingo was played on what was termed "hard cards". These were bingo faces printed on a cardboard substrate. Each card usually contained one bingo face and was reusable. Play usually consisted of placing a plastic marker on each number that was called on the card until the game was completed by someone winning. The markers would then be cleared from the card and the same card or cards would be used for the following game. The bingo players would play the same cards for all the games of the session. The cards were costly to purchase, required maintenance, retrieval, storage, needed frequent replacement, and provided a limited number of bingo faces.

It has now become popular in the playing of bingo to purchase a booklet of bingo sheets each sheet of which has one or more bingo faces printed thereon. These booklets consist of multiple sheets of bingo paper, one stacked upon the other, with the paper sheets being removably secured at one edge to form a booklet. The number of sheets in a booklet is indicated by the term "up." Thus a 10 up booklet means a booklet having ten sheets. Each sheet typically contains a number of bingo faces indicated by the term "on." These can range from a 1 ON to a 36 ON or more. When players enter the bingo hall they may purchase one or more booklets. Each booklet contains one sheet for each game of the evening. The player will then play all of the bingo faces on the first sheet for the first game and mark these faces with a translucent marker, or ink dauber, as each of the numbers is called. Once a winner is declared and the game is over, the player removes the top sheet from the booklet and plays the next game on the following sheet. The marked first sheet is discarded.

With the popularity of bingo growing, the number of players has increased dramatically. Each player may use twelve, eighteen or more bingo faces simultaneously. As a result a bingo hall operator can use 9,000 or more bingo faces in a single game. State of the art communication techniques such as television satellite links may now join many bingo halls together for a combined bingo session. This further increases the potential number of bingo faces played in a single game to 120,000 or more.

In each bingo game, it is highly desirable that each of the players have unique bingo faces on their sheets in order to reduce the possibility that more than one person would win at the same time by having the identical bingo face. Therefore, it is desirable to be able to print a large number of different bingo faces on bingo sheets in order to reduce the occurrence of prize-splitting.

The current process for printing bingo paper usually requires the use of a web printing press that contains a series of standard and, in some cases, proprietary printing units that combine to print the indicia, audit numbers, serial numbers, wax bars, and bingo faces on a web of paper. On these presses the bingo face printing unit consists of an inking system that wets a series of bingo face plates mounted on a continuous belt. When brought into contact with the paper web routed over the unit impression cylinder, the continuous belt transfers the image of the bingo faces onto the paper web. The number of unique bingo faces printed by this system is limited by the length of the continuous belt. For handling purposes and functionality, modern belt systems will accept a belt length that will hold approximately 9000 unique bingo faces which is the accepted industry standard set. If larger numbers of unique bingo faces are required to satisfy the requirements of a game, sets are printed separately using different 9000 face bingo belts and then combined by hand in a process that is termed set collation. This is a time-consuming and labor-intensive process.

Accordingly, it is desirable to develop a new and improved method and apparatus for printing large numbers of bingo faces which would overcome the foregoing difficulties and others while providing better and more advantageous overall results.

BRIEF SUMMARY OF THE INVENTION

This invention relates to an improved method of printing bingo paper that allows a bingo paper manufacturer to print a plurality of bingo sheets on a single web wherein no two bingo faces in a set, regardless of the size of the set, will be repeated with the same border indicia. All appropriate bingo faces destined as the top sheet of a bingo booklet will have an audit number printed on them. Each bingo face within a set of bingo faces will have a common identifying numeral printed on it. The top sheet of each bingo booklet will have wax bars printed, the full width of the web, at the top of each face to allow the booklets to be separated from the stack of booklets after they are glued. The web will be cut into sheets and stacked.

One advantage of the present invention is the provision of a new and improved method for printing bingo booklets.

Another advantage of the present invention is the provision of an improved apparatus for printing bingo booklets which apparatus employs a variable data print unit coupled to a computer as well as a separate indicia print unit.

Still another advantage of the present invention is the provision of an apparatus for printing bingo booklets in which a variable data print unit, coupled to a computer, is employed in line with an indicia print unit to achieve automatic indexing of bingo faces and indicia such that no bingo face will be duplicated using the same indicia within the entire set of bingo faces that are printed, no matter how large the entire set is. The term "series" may be used as the equivalent of a belt revolution of a bingo number belt (albeit a very large belt) which is conventionally used in the manufacture of bingo paper. A "set" can be one or more series of bingo faces. A set is generally defined as the number of unique borders, or other indicia applied to each bingo face, times the number of unique bingo faces. In this case, the series may be up to 120,000 unique faces. A set would be the series of bingo faces multiplied by the number of indicia employed for each face. Thus, with ten indicia, the set would be 1,200,000 bingo faces when the series contains 120,000 unique bingo faces.

Yet another advantage of the present invention is the provision of a method for printing bingo faces in which a large number of bingo faces is stored in a computer that is coupled to a variable data print unit and a first set of bingo faces is printed on a web. Thereafter, a second set of bingo faces is printed on the same web. The first and second set of bingo faces can be of different sizes or of the same size and can have different bingo faces or the identical bingo faces which can be printed in the same order or in a different order. Preferably, an indicia print unit is also used and the sheet of bingo paper will have different combinations of bingo faces and indicia on each sheet of the set of sheets printed on the web.

A further advantage of the present invention is the use of a variable data print unit to print a series of bingo faces on a web in any desired order from a stored set of bingo faces in a computer. The order of bingo faces is limited by a computer command that the same page of bingo faces cut from the web cannot appear twice in the same booklet or, in the same set of booklets with an identical indicium.

A still further advantage of the present invention is the provision of a variable data print unit used to print audit numbers on selected bingo faces on one or more sheets of bingo faces.

A yet further advantage of the present invention is the provision of a variable data printer to print a serial number unique to each set of sheets on all bingo faces of each sheet of that set of sheets. For the next set of sheets, a different serial number would be used.

Still other benefits and advantages of the invention will become apparent to those skilled in the art upon a reading and understanding of the following detailed specification.

BRIEF DESCRIPTION OF THE DRAWINGS

The invention may take form in certain parts and arrangements of parts certain embodiments of which will be described in detail in this specification and illustrated in the accompanying drawings wherein.

DETAILED DESCRIPTION OF THE PREFERRED EMBODIMENTS

Figure 1:
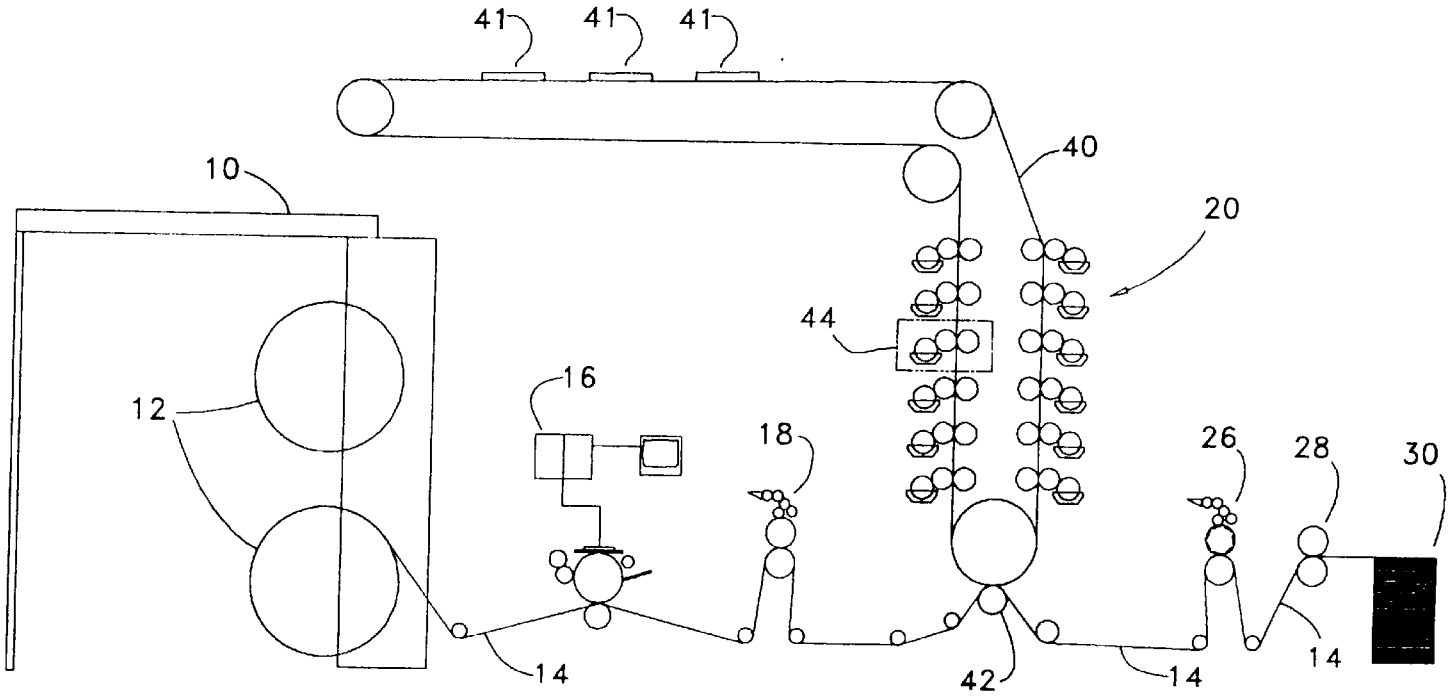
FIG. 1 is a schematic side elevational view of the first embodiment of a printing apparatus according to the present invention including a variable data printing unit and an indicium printing unit.

Referring now to the drawings wherein the showings are for purposes of illustrating preferred embodiments of the present invention and not for purposes of limiting same, the printing apparatus in FIG. 1 includes a roll stand and splicing unit 10 with multiple rolls of paper 12 formed in a web 14. The web 14 travels to a variable data printing unit 16 where the variable bingo faces, audit numbers, and serial numbers are printed. Also printed on each bingo face is a unique free space number for identification. The web then travels to a fixed data printing unit 18 where fixed data such as company names, game patterns and regulating seals can be printed. Subsequently, the web 14 travels to an indicia printing unit 20 where a plurality of indicia, such as border colors in one or more patterns, are printed adjacent to the bingo faces. The web 14 then travels through a wax unit 26 where wax bars are printed on the top sheet of each booklet. Finally, the web 14 travels to a delivery unit 28 where the web is cut into sheets 30 and stacked.

The indicia print unit, wax unit and delivery units are described in greater detail in a co-pending application Ser. No. 08/792,103 filed on Jan. 31, 1997 owned by the assignee of the instant application. That application is incorporated herein by reference in its entirety.

Figure 2A:
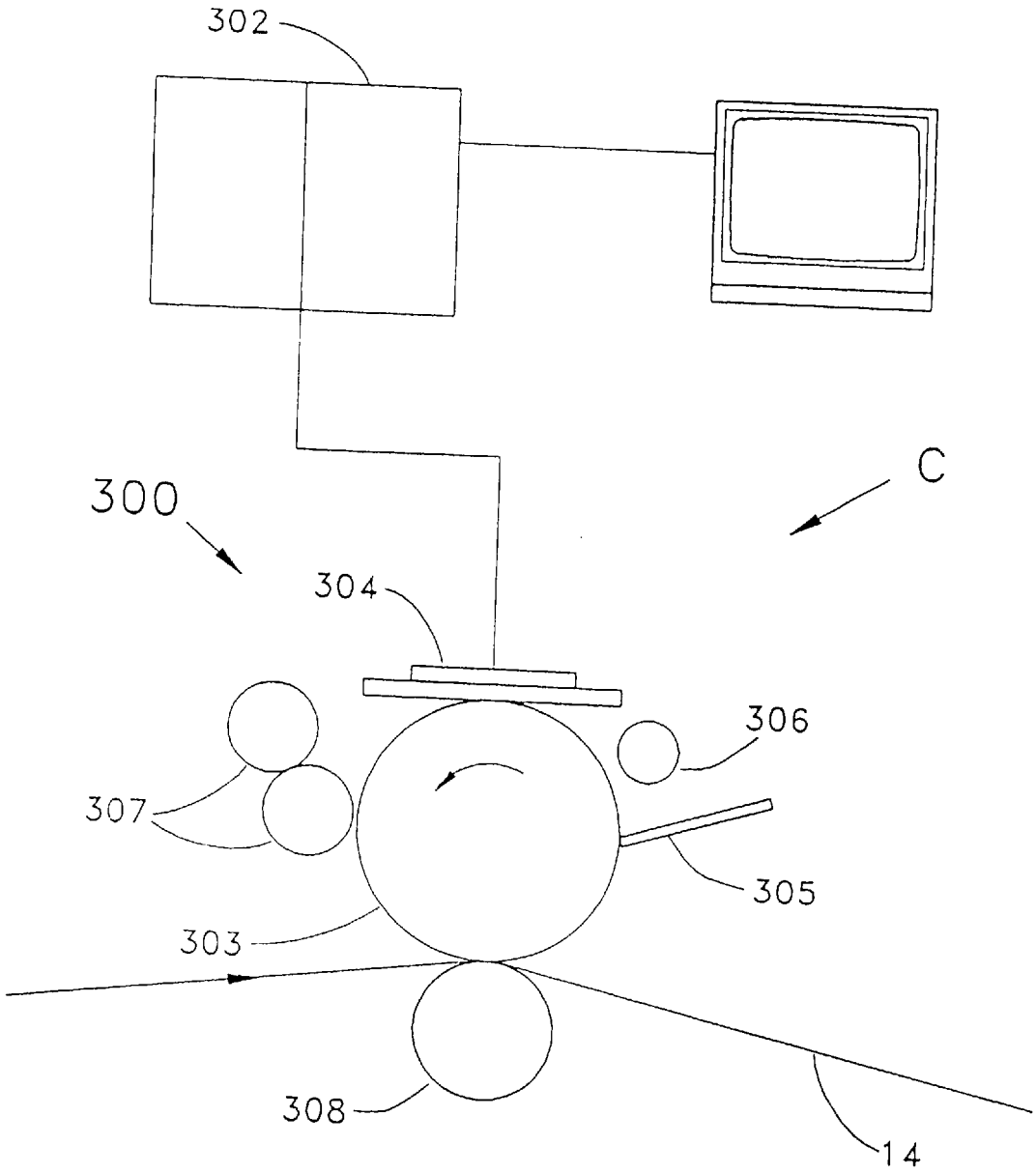
FIGS. 2A through 2C are schematic side elevational views of variable data printing units which can be used with the printing apparatus of FIG. 1.

With reference now to FIG. 2A, the variable data print unit 16 can include one or more conventional nonimpact electronic variable data printing units 300. A computer 302 controls the print content that is printed by a dielectric printing cylinder 303 by means of a print cartridge 304. A scraper blade 305, erase rod 306 and toner rods 307 are also present. The unit shown in FIG. 2A is a DigiPress Electron Beam Imaging Printer by Digital Print, Inc., Fort Worth Tex. This invention is not limited to use of the DigiPress unit as other variable data print units could also be used. Suitable additional such units are shown in FIGS. 2B and 2C.

Figure 2B:
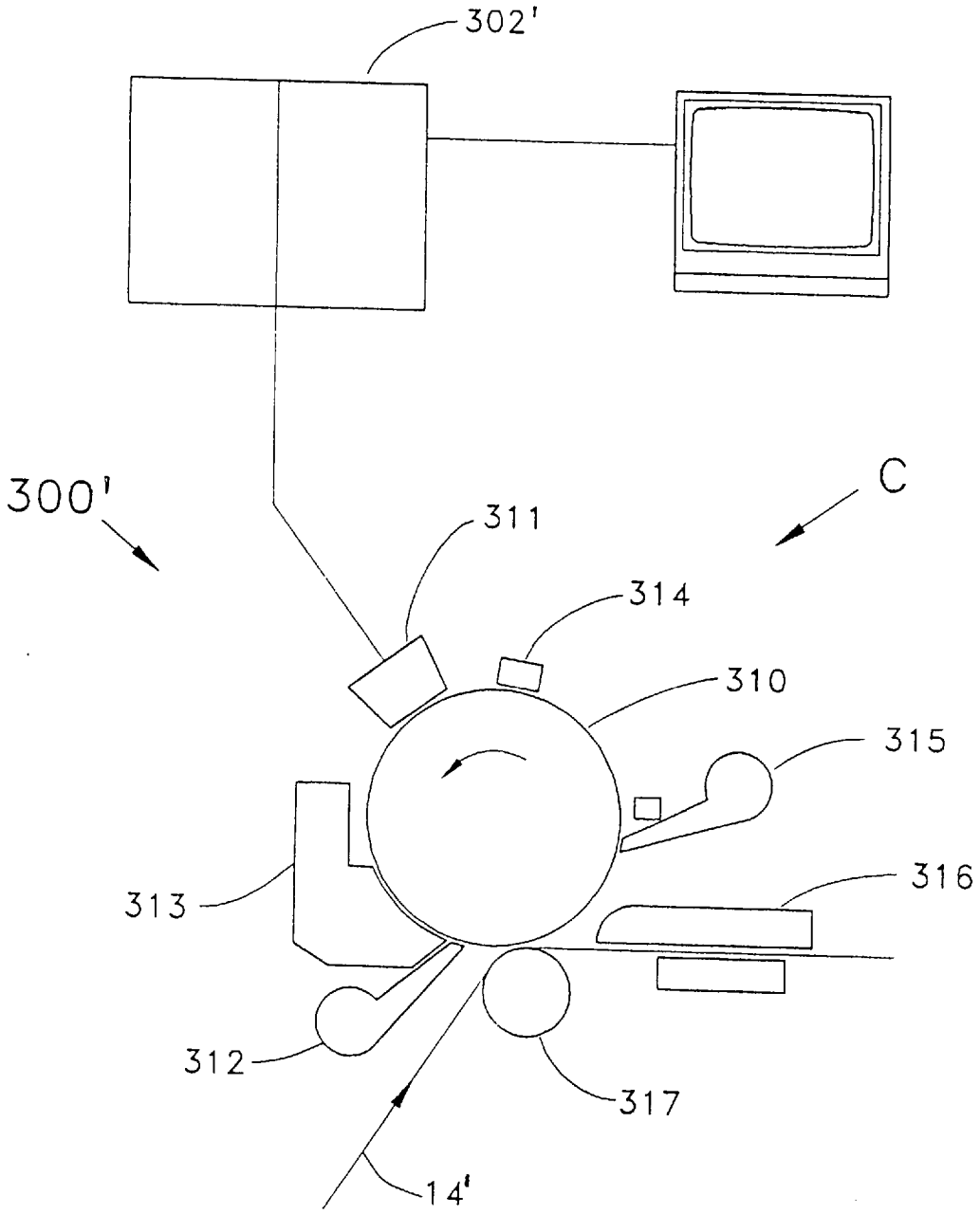

With reference to FIG. 2B, like components in this embodiment are identified by like numerals with a primed (') suffix and new components are identified by new numerals. In this embodiment, a computer 302' controls the print content that is printed by a magnetographic print cylinder 310 by means of recording heads 311. A vacuum retouch 312, toner hopper 313, erase bar 314, cleaning station 315 and flash fuser 316 are also present. A web 14' passes over a transfer roller 317 and then goes to the fixed data print unit. The unit shown in FIG. 2B is a Varypress unit manufactured by Nipson Printing System, N. Billerica Me.

Figure 2C:
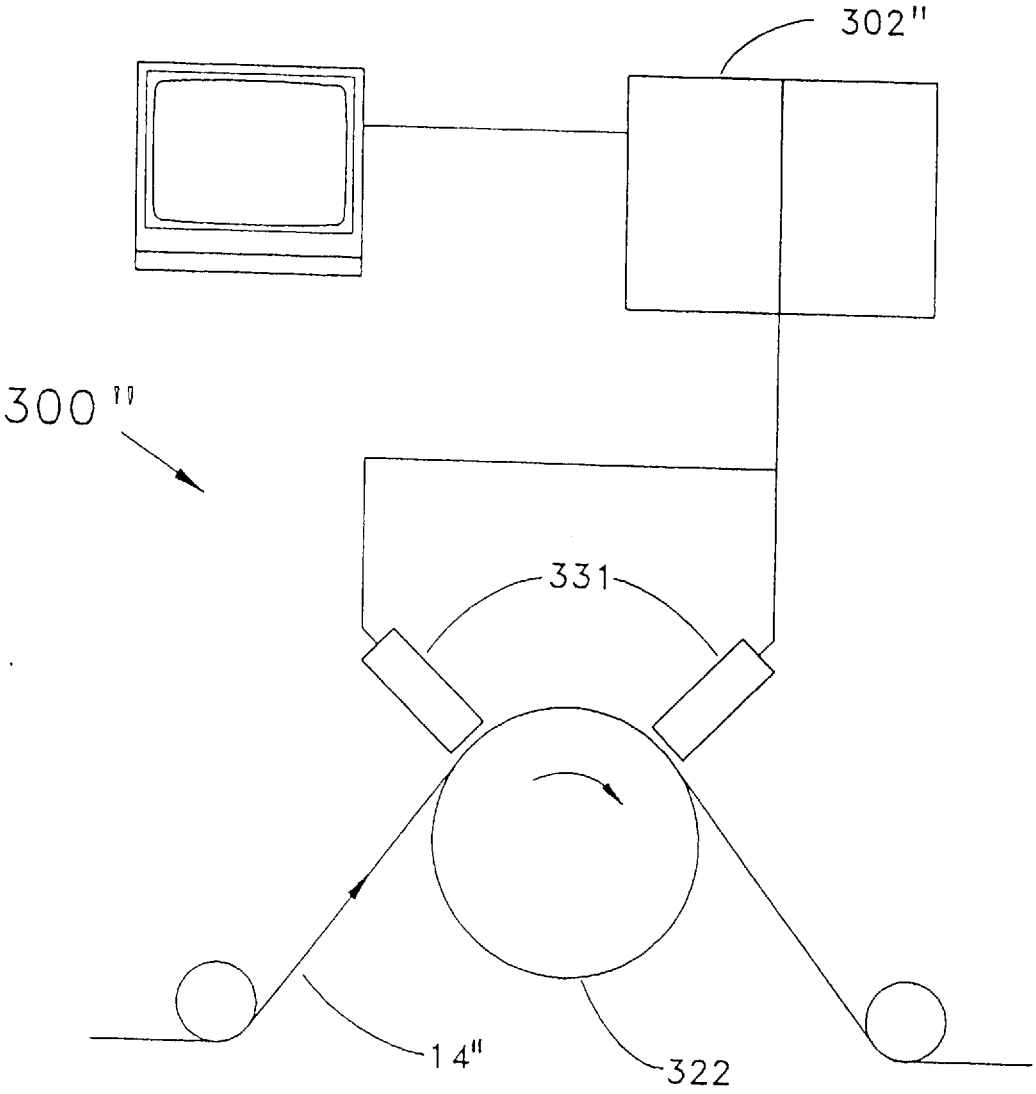

With reference to FIG. 2C, like components in this embodiment are identified by like numerals with a double primed (") suffix and new components are identified by new numerals. In this embodiment, a computer 302" controls the print content that is printed by a series of ink jet printers 331. A web 14" passes over a transfer roller 332 and then goes to the fixed data print unit. The unit shown in FIG. 2C is manufactured by Zeiser GMBH, West Germany.

The variable data printing unit 16 may be programmed to print a series of bingo faces. The length of the series of bingo faces is limited only by the storage capacity of the device containing the database of bingo faces or by the mathematical limit of unique bingo faces. When printing a standard set of bingo paper of the style preferred in the United States, there are usually 9000 unique bingo faces in it. To facilitate printing and processing, these faces are usually arranged in a 4×6 matrix with 24 faces on each of 375 pages, or in a 6×6 matrix with 36 faces on each of 250 pages. The first series of bingo faces will print in a first prescribed order. The border indicia, printed by the indicia printing unit 20, will print in a prescribed order adjacent to the faces. This order of border indicia will continue to repeat. The second series of bingo faces will print in a second prescribed order. The third series of faces will print in a third prescribed order and so on. The number of prescribed orders will equal the number of different border indicia blocks held on a belt 40 of the indicia printing unit 20. The completed set, of one or more series, will consist of 375, 24-on booklets, or 250, 36-on booklets. Each booklet will have the same sequence of border indicia, but without any repeat bingo faces in the same booklet or border indicia.

However, the variable data print unit 16 is not limited to 24 faces and 375 pages, or 36 faces and 250 pages as other face and page combinations can be used. Also it is not limited to a 9000 face series because any desired length series could be used. Another advantage of this system is that the preselected order of faces is not limited. The current method of printing bingo faces uses a belt that is identical for all the different border indicia and therefore cannot satisfy a preferred combination for more than one series. An example of a preferred combination would be for the upper left face to have the face identification numbers in numerical order on successive sheets for ease of checking. With the variable data print unit 16 according to the present invention, one can print a series, e.g., the equivalent of ten different series of bingo faces just as if one were using ten different bingo face belts, one after another, on the web. If one were then using ten different indicia, a 10-Up set of bingo faces would be created. That is, bingo numbers the total of which is equivalent to ten different series in each of ten different indicia.

It can be seen that with a prime number of pages, such as 379 with a 24-on sheet, or 251 with a 36-on sheet, a common prescribed order of bingo faces can be used without repeating a bingo face on the same border indicia within a set.

Because the variable data print unit is connected to a computer which stores a large number of bingo faces, it is possible to print on a web series of bingo faces which contain different quantities of pages such that the second (and any subsequent) series of bingo faces is smaller or larger than the first series of bingo faces. It is moreover possible to print series of bingo faces in which the second (and any subsequent) series of bingo faces is different from the first series of bingo faces in that one, several, most or all of the bingo faces in the first series are absent from the second series. Alternatively, it is also possible to use the same bingo faces in the second series of bingo faces as was used in the first series, but to print them in a different order. Of course, it should also be recognized that the same bingo faces can be printed in the same order in the second series of bingo faces as was printed in the first series and that the two series of identical bingo faces are printed on the web in tandem. The size of such series can be varied as desired from, e.g., 9,000 faces to 120,000 faces or more.

With reference once again to FIG. 1, the variable data printing unit 16 can print the series of bingo faces in a randomly generated order from a stored series of bingo faces. The order must be limited by the restriction that the same face cannot appear twice in identical border indicia, or in the same booklet. The bingo face can refer to a single face or preferably a face-page combination of faces where the faces for each page when properly selected assure similar looking faces will not be adjacent and that every number called will be represented in an adjacent group of 6 faces. To ensure the last face-page combination fits this restriction, extra face-page combinations can be stored in the computer.

Figure 3:
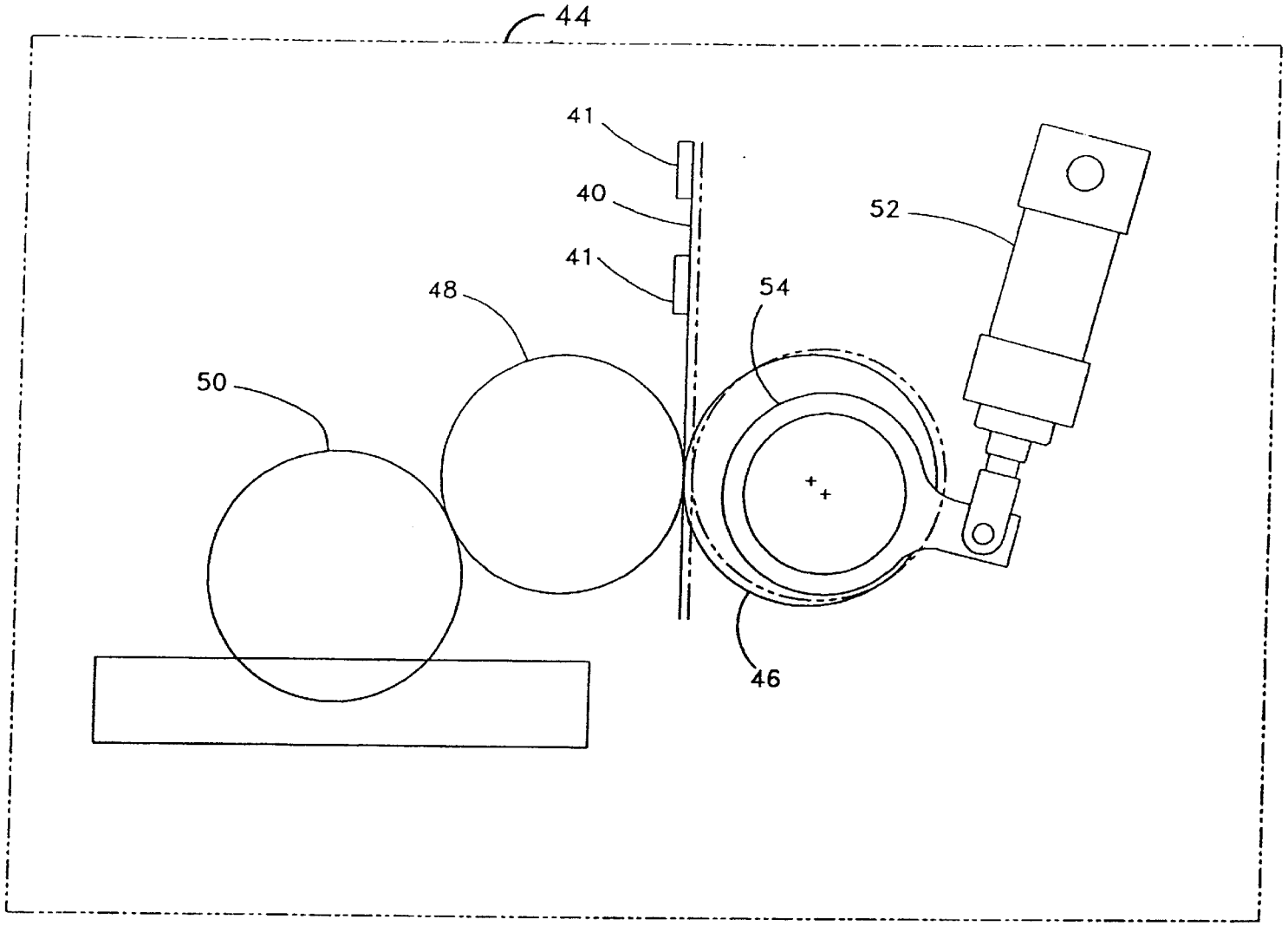
FIG. 3 is a schematic side elevational view of one of a plurality of inking stations of the indicium printing unit of FIG. 1.
Figure 4:
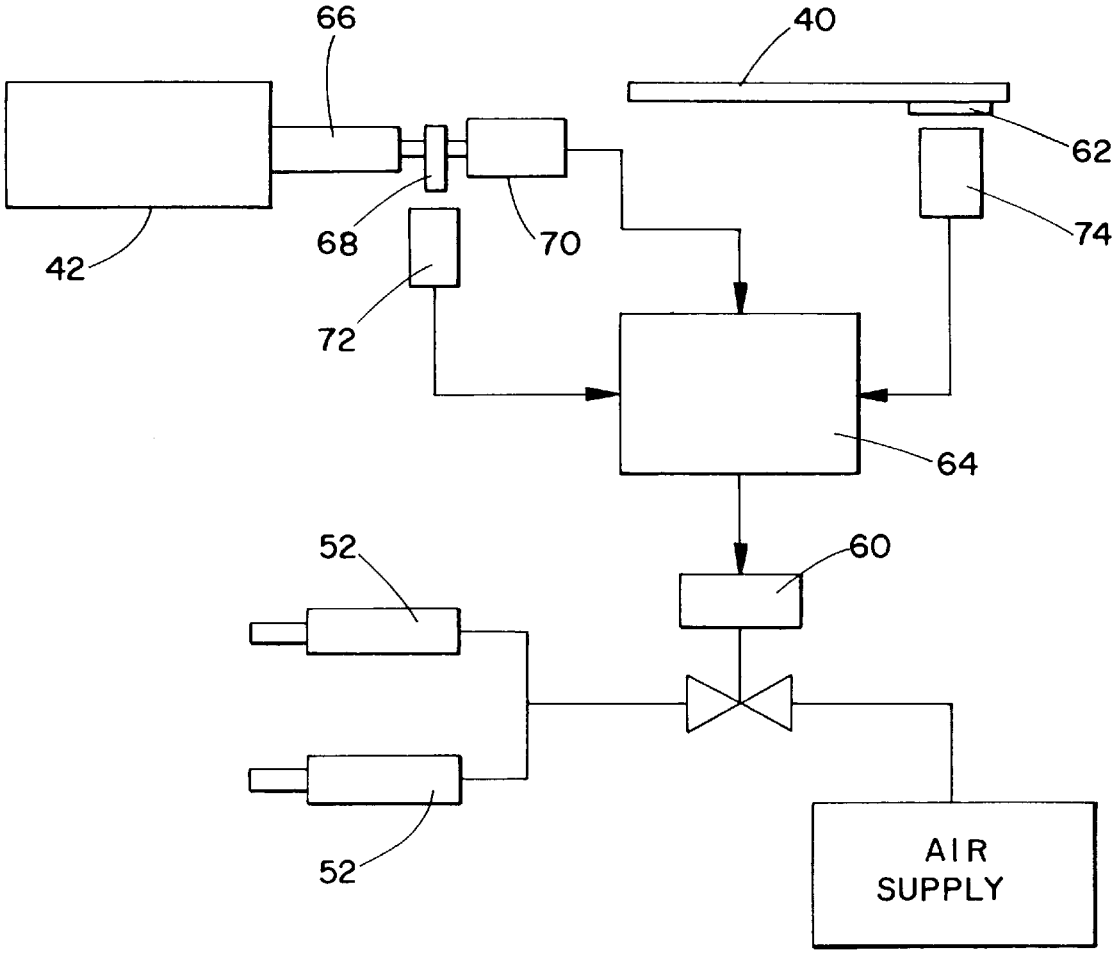
FIG. 4 is a schematic view of the control assembly for the indicium printing unit of FIG. 1.

With reference to FIGS. 1 & 3, the indicia printing unit 20 prints a plurality of colored border indicia adjacent to the bingo faces on the web 14 over a common impression cylinder 42. The indicia plates 41 are wetted on the belt 40 by a plurality of inking stations 44 including an ink transfer roll 46, an anilox roll 48 and a pan roll 50. With reference now to FIG. 4, the system that effects movement of the ink transfer roll 46 is a pneumatic system comprised of a solenoid operated pneumatic valve 60 which directs the flow of pressurized air to two air cylinders 52. The air cylinders 52 rotate a pair of eccentrics 54 moving the ink transfer roll 46 into contact with belt 40. Belt 40, by the contact of the ink transfer roll 46, forces the indicia plates 41 into contact with the anilox roll 48 which is kept constantly wetted with ink by pan roll 50. The ink transfer roll can be moved in and out of contact with belt 40 in any desired sequence at any desired point on the belt.

The pneumatic system is controlled by a conventional computer 64 which can include, e.g. an 80386, 80486, or Pentium type microprocessor. It must be appreciated that the system may also be controlled by a conventional programmable controller used singly or in conjunction with a microcomputer. The border belt system relationship is initialized by a metallic tape 62 precisely positioned on belt 40 that is sensed by proximity sensor 74. The system timing is controlled by the output of a conventional encoder 70 which is connected to the journal 66 of the impression cylinder 42. A flag 68 is mounted on the journal 66 such that, as the journal rotates, the flag triggers a conventional proximity sensor 72 to provide an index pulse to the computer 64. The pulse train from the encoder is used to provide a count to the computer 64 for regulating the movement of the twelve ink transfer rolls 46, one for each inking station 44.

There are twelve solenoid operated pneumatic valves 60, twelve pairs of cylinders 52, and twelve sets of eccentrics 54 that are used. One group for each of the twelve inking stations. The index pulse provided by the flag 68 passing the proximity sensor 72 provides a reference to the computer 64 to check the integrity of the pulse train from the encoder 70. The control system provides electrical power to the solenoid operated pneumatic valve 60 to direct the pressurized air to a prescribed end of the cylinders 52 to rotate the eccentrics and move the ink transfer rolls 46 into or out of contact with belt 40.

It should be appreciated that the number of inking stations is not limited to 12 but could be any desired number. It should also be appreciated that the number of different indicia is not limited by the number of inking stations since by using two or more different patterns, such as solid blocks and striped blocks, the colors can be repeated and still provide a distinctive indicia.

The above described indicia printing unit is fully described in a patent application entitled "Method and Apparatus for Printing Bingo Books". It is owned by the assignee of the present invention. That application Ser. No. 08/792,103 was filed on Jan. 31, 1997.

A bingo face is generally understood to include the matrix of twenty-four numbers and a free space, as well as a border indicium, a serial number and, if present, an audit number.

Figure 5:
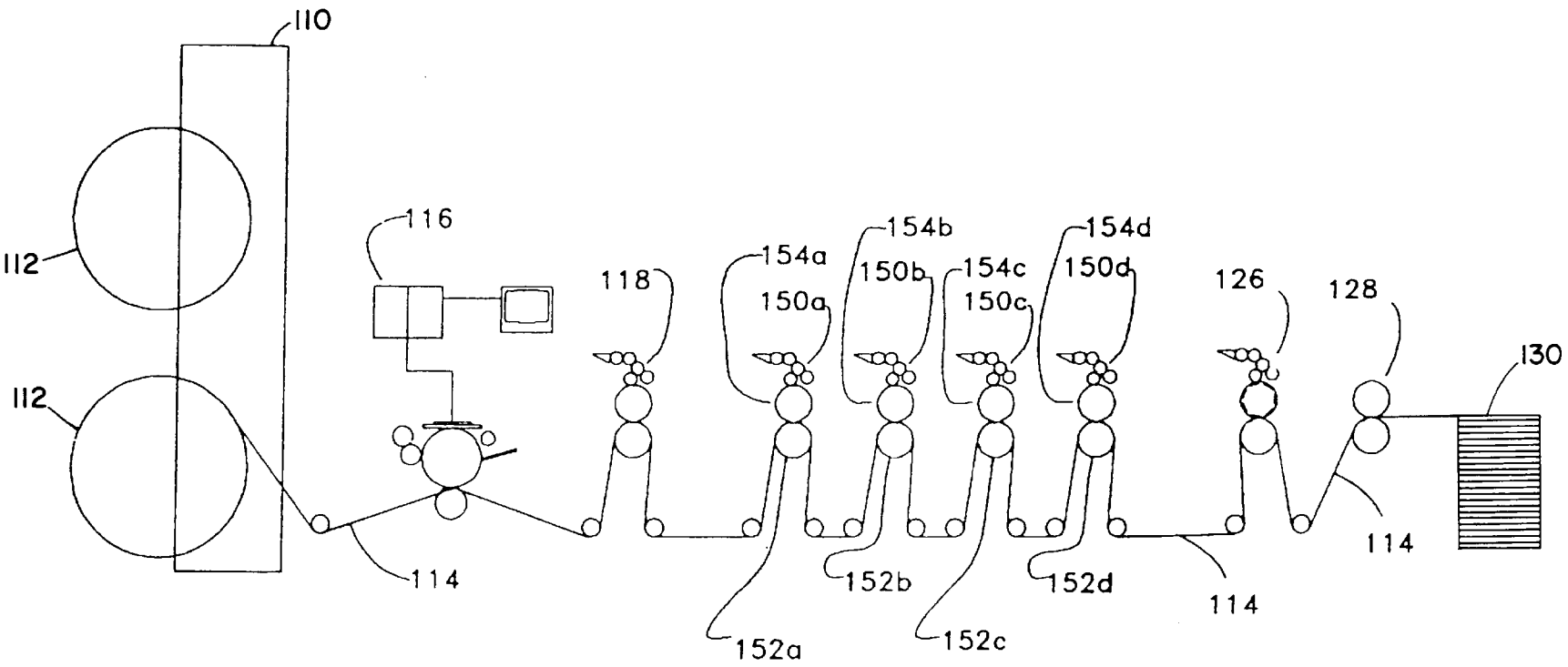
FIG. 5 is a schematic side elevation view of the second embodiment of the printing apparatus according to the present invention.

FIG. 5 illustrates a second embodiment of this invention. Since some of the printing apparatus in the second embodiment is identical to the first embodiment, the identification numbers of these identical parts will be increased by 100.

The printing apparatus consists of a roll stand and splicing unit 110 with multiple rolls of paper 112. A web of paper 114 travels to a variable data printing unit 116 where the variable bingo faces, audit numbers, and serial numbers are printed. The web then travels to a fixed data printing unit 118 where fixed data can be printed. The web 114 then travels to a set of indicia printing units 150*a*–150*d* where the plurality of border indicia are printed adjacent to the bingo faces. The web 114 then travels through a wax unit 126 where wax bars are printed on the top sheet of each booklet. The web 114 then travels to the delivery unit 128 where it is cut into sheets 130 and stacked.

The second embodiment differs from the first embodiment by the type of indicia print units. The indicia print units 150*a*–150*d* print a plurality of colored border indicia adjacent to the bingo faces on the web 114 in any desired sequence. Each unit consists of an impression cylinder 152 to support the web 114 and a plate cylinder 154 to transfer the ink to the web 114. The impression cylinders 152*a*–152*d* move in and out of the print position by some means such as, but not limited to, the air cylinder and eccentric described in FIG. 3. The sequence and system timing may be controlled either by a conventional computer and/or a conventional programmable controller as described for FIG. 4 of the first embodiment. It can be appreciated that the plate cylinders 154*a*–154*d* could be moved in and out of print position instead of the impression cylinders 152*a*–152*d*. It should be appreciated that the number of indicia print units is not limited to four. Rather, any desired number could be used.

It can be seen that the advantage of the first embodiment of FIG. 1 over the second embodiment of FIG. 5 is in space and equipment savings. Also the belt 40 on the first embodiment allows a color to be repeated with a different pattern to provide a distinctive border indicia thus reducing the number of printing units required.

It can be appreciated that the indicia printing can be done by a combination of one or more variable data print units and, if desired the print unit 20 shown in FIG. 1. In this way any combination of different border colors or shapes can be printed on consecutive sheets or even on the same sheet.

Figure 6:
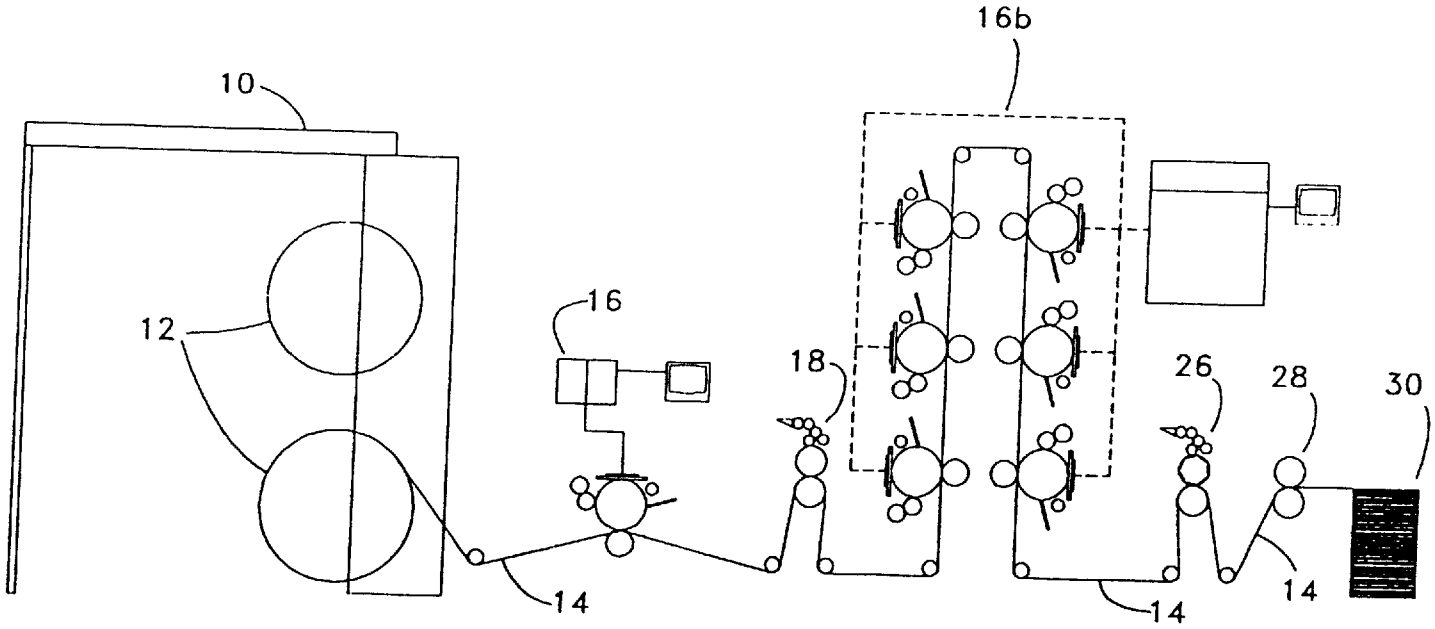
FIG. 6 is a schematic side elevational view of a printing apparatus depicting a multi-color variable data printing unit for indicia printing according to a third embodiment of the present invention.

With reference to FIGS. 1 and 6, it can be appreciated that a multicolor variable data print unit 16*b* can totally replace the indicia print unit 20 illustrated in FIG. 1. While a six station print unit is illustrated in FIG. 6, the multicolor variable data print unit is not limited to 6 stations. Other than the use of a multicolor variable data print unit 16*b*, the printing apparatus in FIG. 6 is identical with the printing apparatus illustrated in FIG. 1. Therefore, identical numerals are used therein.

Figure 7A:
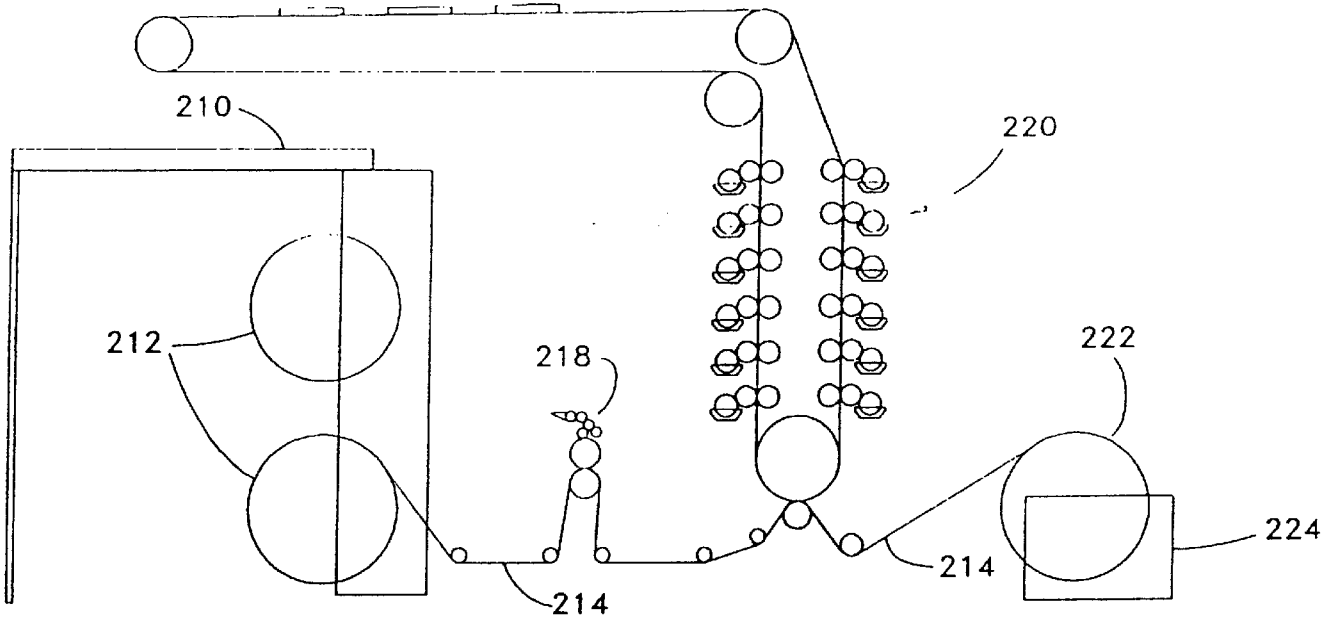
FIGS. 7A and 7B are schematic side elevational views depicting a roll to roll system for separately printing indicia on a web and a roll to sheet system including a variable data printing unit for printing bingo faces according to a fourth embodiment of the present invention.
Figure 7B:
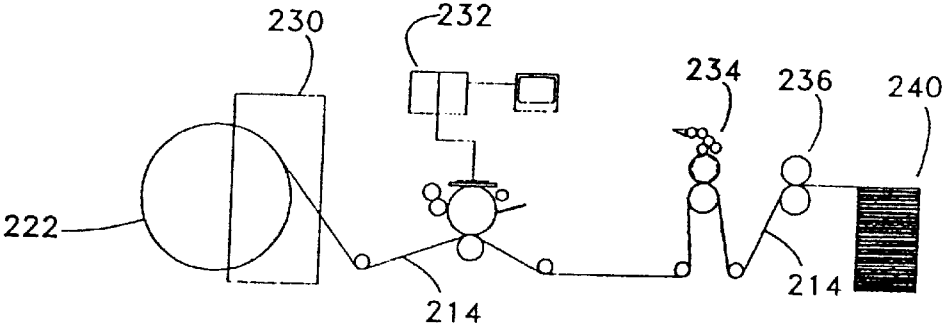

It can be appreciated that reasonable variations are possible within the scope of the invention. For example, and with reference to FIGS. 7A and 7B, the border indicia can be printed roll to roll on a separate machine by any of the aforementioned means and the bingo faces then printed on another machine using one of the previously described variable data printing devices and then sheeted. Conversely, the variable data printing could be done roll to roll on a separate machine and then the border indicia added and the stock sheeted.

In this embodiment, the printing apparatus can consist of a first roll stand and splicing unit 210 on which multiple rolls of paper 212 are held. A web of paper 214 travels to a fixed data printing unit 218 and then to an indicia printing unit 220. Subsequently, the web is rewound at 222 in a winding unit 224. Thereafter, the rewound web is moved to an unwind unit 230. The web is then unwound and proceeds through a variable data printing unit 232. Subsequently, the web travels to a wax unit 234 and subsequently to sheeter/stacker unit 236. Finally, stacked sheets of bingo paper 240 are provided.

The invention has been described with reference to preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A method of manufacturing bingo paper comprising the steps of:

storing a plurality of preformulated bingo faces in a memory of a computer;

connecting the computer to a variable data print unit;

programming the computer to print a first series of the plurality of the bingo faces on a web in a first preselected order;

programming the computer to print a second series of the plurality of bingo faces on the web in a second preselected order, wherein the same bingo faces are printed in said first and second series of bingo faces.

2. The method of claim 1 further comprising the step of:

printing an indicium on each bingo face of said first series of bingo faces; and, printing an indicium on each bingo face of said second series of bingo faces.

3. The method of claim 2 wherein said step of printing an indicium comprises the subsidiary steps of:

printing a first pattern sequentially in each of a plurality of colors; and, subsequently printing a second pattern sequentially in each of a plurality of colors.

4. The method of claim 2 further comprising the step of printing desired data on preselected areas of said web, wherein said step of printing desired data is performed before said steps of printing an indicium.

5. The method of claim 2 wherein said step of programming the computer comprises the subsidiary steps of:

picking the plurality of bingo faces from the memory of the computer in a randomly generated order;

insuring that a same bingo face in the plurality of bingo faces does not appear twice with an identical indicium; and, insuring that the same bingo face in the plurality of bingo faces does not appear twice in the same set of sheets which will form a booklet.

6. The method of claim 1 further comprising the step of:

separating the web into a plurality of sheets; and, securing the sheets together into at least one booklet.

7. The method of claim 1 further comprising the steps of:

printing a common serial number on each bingo face; and, printing an audit number on at least preselected ones of the plurality of the bingo faces.

8. The method of claim 1 wherein said second series of the plurality of bingo faces is different in size from said first series of the plurality of bingo faces.

9. The method of claim 1 wherein the first preselected order is different from the second preselected order.

10. A method of printing bingo sheets on a web of paper wherein each sheet has at least one bingo face which is designated by an indicium wherein a different combination of bingo faces and indicia is provided on each sheet, comprising the steps of:

providing a web;

storing a plurality of preformulated bingo faces in a memory of a computer;

connecting the computer to a variable data print unit;

programming the computer to print a first series, of a desired first size, of the plurality of bingo faces;

sequentially printing the first series of the plurality of bingo faces on the web in a desired first order on defined sequential longitudinally spaced areas on the web;

programming the computer to print a second series, of a desired second size, of the plurality of bingo faces;

sequentially printing the second series of the plurality of bingo faces on the web in a desired second order on defined sequential longitudinally spaced areas on the web printing an indicium adjacent each bingo face of said first series of bingo faces and printing an indicium adjacent each bingo face of said second series of bingo faces on the web; and, insuring that the same bingo face in the first and second series does not appear twice with an identical indicium.

11. The method of claim 10 wherein said first order of bingo faces is different from said second order of bingo faces.

12. The method of claim 8 wherein said step of programming the computer comprises the subsidiary steps of:

picking the plurality of bingo faces from the memory of the computer in a randomly generated order; and, insuring that the same bingo face in the plurality of bingo faces does not appear twice in the same series of sheets which will form a booklet.

13. The method of claim 8 wherein said step of printing an indicium comprises the subsidiary steps of:

printing the indicium in each of a plurality of colors in a first pattern; and, subsequently printing the indicium in each of a plurality of colors in a second pattern.

14. The method of claim 8 wherein said step of printing an indicium comprises the subsidiary step of printing a plurality of different borders which will each extend around at least a portion of a circumference of a bingo face printed during said steps of sequentially printing the first series and the second series of bingo faces.

15. The method of claim 10 further wherein said first size of the first series of bingo faces is different from said second size of the second series of bingo faces.

16. The method of claim 10 further comprising the step of:

printing an identifying numeral in each of said defined sequential areas on the web; and, printing an audit number on preselected ones of said sequential areas on the web.

17. The method of claim 10 further comprising the step of cutting the web into predetermined lengths after said step of sequentially printing the second series of bingo faces.

18. A method for printing bingo game booklets comprising the steps of:

providing a web of paper;

defining discrete areas on the web;

storing a plurality of preformulated bingo faces in a memory of a computer;

connecting the computer to a variable data print unit;

printing a first series of the plurality of bingo faces on the discrete areas of the web;

printing a second series of the plurality of bingo faces on the discrete areas of the web;

insuring that only desired ones of the plurality of bingo faces of said second series of bingo faces are identical with the plurality of bingo faces printed in said first series of bingo faces;

sequentially printing an indicium on each bingo face in each of the first series and second series of bingo faces;

cutting the web into a plurality of sheets; and, assembling the plurality of sheets into at least one booklet.

19. The method of claim 18 wherein the first series of bingo faces is of a different size than is the second series of bingo faces.

20. The method of claim 18 wherein the bingo faces in the first series of bingo faces are in a different order from the bingo faces in the second series of bingo faces.

21. The method of claim 18 wherein said step of sequentially printing an indicium comprises the subsidiary step of printing a border which will extend around at least a portion of a circumference of the bingo face printed during said steps of printing a first series and printing a second series.

22. The method of claim 18 further comprising the step of printing an audit number on preselected ones of the defined sequential areas on the web of paper.

23. The method of claim 18 further comprising the step of printing an identifying numeral in each of the bingo faces printed on the web of paper.

24. The method of claim 18 wherein said step of printing an indicium comprises the subsidiary steps of:

printing the indicium in each of a plurality of colors in a first pattern; and, subsequently printing the indicium in each of a plurality of colors in a second pattern.

25. The method of claim 18 wherein the sheets of the web are cut into master bingo sheets and wherein said step of assembling the sheets into at least one booklet comprises the subsidiary steps of:

cutting the master sheets into a plurality of smaller sheets;

stacking the smaller sheets atop each other in a predetermined sequence; and, securing an edge of each smaller sheet to each adjacent smaller sheet.

26. The method of claim 25 wherein said step of securing an edge of each smaller sheet forms a master stack of booklets and wherein said step of assembling further comprises the subsidiary step of separating the master stack of booklets at predetermined locations to form individual booklets, wherein each booklet has identical indicia and each sheet of each booklet has an indicium either in a different color or in a different pattern from each other sheet in the booklet.

27. An apparatus for printing bingo paper comprising:

a computer including a memory storing a plurality of bingo faces;

a variable data print unit to which the computer is connected;

a web which is fed through the variable data print unit;

a means for regulating which ones of said plurality of bingo faces are printed on said web, and in which order, for a first series of bingo faces printed on the web and which ones of said plurality of bingo faces are printed on said web, and in which order, for a second series of bingo faces printed on the web in tandem with said first series of bingo faces; and, an indicium print unit, located adjacent said variable data print unit, through which the web is also fed.

28. The apparatus of claim 27 wherein said computer is also connected to said indicium print unit.

* * * * *